US009453357B1

(12) United States Patent
Bertato

(10) Patent No.: US 9,453,357 B1
(45) Date of Patent: Sep. 27, 2016

(54) GLASS FENCE SUPPORT SYSTEM

(71) Applicant: Maurizio C. Bertato, Uxbridge (CA)

(72) Inventor: Maurizio C. Bertato, Uxbridge (CA)

( * ) Notice: Subject to any disclaimer, the term of this patent is extended or adjusted under 35 U.S.C. 154(b) by 0 days.

(21) Appl. No.: 14/756,011

(22) Filed: Jul. 20, 2015

(51) Int. Cl.

| | |
|---|---|
| ***E04H 17/16*** | (2006.01) |
| ***E04C 2/54*** | (2006.01) |
| ***E04B 2/00*** | (2006.01) |
| ***E04H 12/22*** | (2006.01) |

(52) U.S. Cl.
CPC ..... *E04H 17/168* (2013.01); *E04C 2/46* (2013.01); *E04C 2/54* (2013.01); *E04H 12/2238* (2013.01); *E04H 17/16* (2013.01)

(58) Field of Classification Search
CPC ..... E04F 11/1812; E04F 11/1851; E04F 11/1853; E04F 11/00; E04H 17/16; E05D 5/0246; E06B 3/02; E06B 3/54; E06B 3/549; E06B 3/5454; E04B 2/7425; E04B 2/7455; E04B 2/7435; E04B 2/7405
See application file for complete search history.

(56) References Cited

U.S. PATENT DOCUMENTS

| | | | | | |
|---|---|---|---|---|---|
| 4,689,853 | A * | 9/1987 | Marinoni | E05D 5/0246 | 16/382 |
| 4,841,697 | A * | 6/1989 | Hogg | E04F 11/1851 | 198/335 |
| 4,870,793 | A * | 10/1989 | Tomlinson | E04F 11/1851 | 52/126.1 |
| 4,914,888 | A * | 4/1990 | Hanson | E06B 3/02 | 52/656.5 |
| 5,029,820 | A * | 7/1991 | Katz | E04F 11/1812 | 256/59 |
| 5,067,294 | A * | 11/1991 | McGowan | E04B 2/7425 | 52/239 |
| 5,069,010 | A * | 12/1991 | Trainor, Jr. | E06B 3/02 | 52/127.8 |
| 5,444,958 | A * | 8/1995 | Lu | E05D 7/1005 | 52/204.67 |
| 5,613,276 | A * | 3/1997 | Franz | A47K 3/36 | 16/229 |
| 6,643,898 | B1 * | 11/2003 | Cameron | A47K 3/36 | 16/309 |
| 6,715,245 | B2 | 4/2004 | Lewkowitz | | |
| 6,766,561 | B1 * | 7/2004 | Cheng | E05D 5/0246 | 16/235 |
| 6,964,410 | B1 * | 11/2005 | Hansen | E04F 11/1812 | 256/23 |
| 7,305,797 | B2 * | 12/2007 | Chiang | E05D 5/0246 | 16/252 |
| 7,493,673 | B2 * | 2/2009 | Garrett | E05D 5/0246 | 16/252 |
| 7,559,536 | B1 * | 7/2009 | Hansen | E04F 11/1851 | 256/25 |
| 7,866,636 | B1 * | 1/2011 | Hansen | E04F 11/1836 | 256/65.14 |
| 8,371,460 | B2 * | 2/2013 | Ghatikar | E04B 2/7435 | 211/175 |
| 8,500,110 | B2 * | 8/2013 | Allen | E04F 11/1851 | 269/297 |
| 8,549,817 | B2 * | 10/2013 | Burke | A47F 3/12 | 52/716.8 |
| 8,695,938 | B1 * | 4/2014 | Rokvic | E04F 11/1853 | 248/475.1 |
| 8,833,018 | B2 * | 9/2014 | Reinecke | E04F 11/1812 | 248/181.1 |
| 8,864,109 | B2 | 10/2014 | Cochrane | | |
| 2004/0148738 | A1 * | 8/2004 | Moss | E05D 5/0246 | 16/221 |
| 2005/0246981 | A1 * | 11/2005 | Austin | E04F 11/1851 | 52/208 |
| 2011/0239560 | A1 * | 10/2011 | Landeros | E06B 3/305 | 52/204.61 |
| 2014/0191175 | A1 * | 7/2014 | Bertato | E04H 17/16 | 256/31 |
| 2015/0043965 | A1 * | 2/2015 | Mao-Cheia | E05D 5/0246 | 403/338 |
| 2015/0330562 | A1 * | 11/2015 | Bonomi | F16M 13/022 | 248/558 |

* cited by examiner

*Primary Examiner* — Daniel Wiley

(57) ABSTRACT

A glass fence support system for supporting a plurality of glass panels and having a plurality of spaced apart clamp blocks, each defining a channel to receive the edge of the glass panel, and through fastenings in the blocks for passing fastening through openings in the glass panels to secure them in the channels, and a plurality of positioning holes for securing the clamp blocks to a substrate.

17 Claims, 5 Drawing Sheets

GLASS FENCE SUPPORT SYSTEM

FIELD OF THE INVENTION

The invention relates to a fences incorporating glass panels and in particular to a fence support system in which the glass panels are supported in a series of clamp blocks with channels for receiving the edges of the glass panels.

BACKGROUND OF THE INVENTION

Fence systems are usually made of either wood or metal. They are an obstruction to views of the surrounding terrain or the building, and they also require periodic maintenance.

Fence systems incorporating glass panels are becoming increasingly popular, because glass is virtually maintenance free, and also because glass permits visual enjoyment of the surroundings and is less intrusive.

In order to provide sufficient strength, it has been the practice to use glass panels of considerable thickness. Glass of this type is expensive. The clamps for holding the edges of the glass panels can also represent a heavy expense. Many such clamps have several components, formed of cast metal, which must be assembled on site. All of this means that glass panel fences in the past, have been a relatively expensive solution to a problem. Another factor is that the glass panels will require holes to be formed at spaced intervals along the edges of the panels. The holes will receive fastening pins or bolts of various kinds. Forming such holes at precise locations in glass panels represents a considerable further expense. One solution has been to provide glass panel fences in which the glass panels were supported top or bottom in a metal rail system. The metal rail system was specially extruded and formed with continuous channels, so that the edges of the glass panels along the bottom and top edge of the panel could be held within such channels and secured. This of course in turn requires specially formed metal fence posts and metal railings with channels dimensioned and designed specifically to receive the glass panels of a predetermined thickness. Clearly it is desirable to make a glass fence system which is more adaptable to a variety of different locations, and having clamps which are adaptable to a variety of different types of fence posts and supporting rails. In this way, it also lends itself to the use of glass panels of somewhat reduced thickness. The net result of all these modifications can be a considerable reduction in costs.

BRIEF SUMMARY OF THE INVENTION

With a view to overcoming these various disadvantages, the invention provides a glass fence support system for a fence having a plurality of glass panels, and having a plurality of spaced apart clamp blocks, each defining a channel to receive the edge of the glass panel, and through fastenings in said clamp blocks passing through openings in the glass panel to secure it in the channel, and a plurality of positioning holes for securing the clamp to a substrate.

Preferably the fence support system will incorporate a plurality of vertical fence posts. The clamp blocks may be secured in spaced apart locations on said posts for securing upright edges of said glass panels.

Optionally there may be both upper and lower rails with upper and lower clamp blocks secured to the upper and lower rails, securing upper and lower edges of the glass panels between them.

Preferably the fastenings for securing the clamp blocks to the substrate will pass through holes formed in the bottom of the channel with semi circular groove formations formed in opposite sides of the channel permitting fastenings to be secured there through.

In a further embodiment, spacer pads may be employed to accommodate slight variations in spacings of upright post members in a fence system, positioning the clamp blocks in the correct location for securing the edges of the glass panels. Preferably there will be at least two types of clamp blocks, one being an intermediate clamp block in which the channel is open at both ends, for securing an intermediate position of the glass panel, and the other of said clamp blocks being an end clamp block having a blind end formed at one end of the channel for securing the opposite ends of the glass panel at its corners.

In one embodiment, the clamp blocks may be formed of a synthetic material, and may incorporate a metal reinforcement within the material.

In a particularly preferred embodiment, the clamp blocks may be made in two portions, to facilitate the positioning of the glass relative to the clamp blocks.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

Figure 11A:
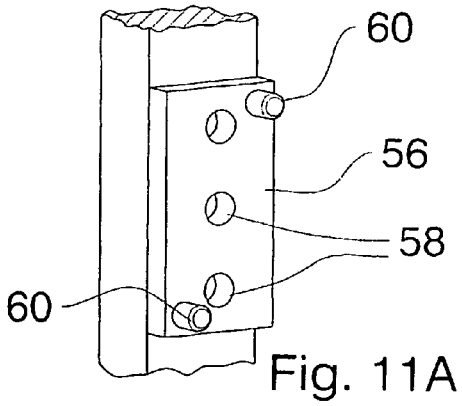
Figure 11B:
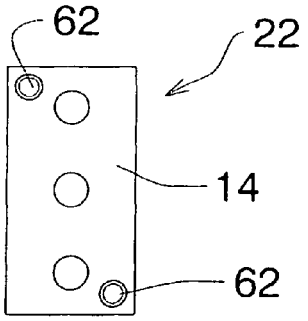
Figure 13:
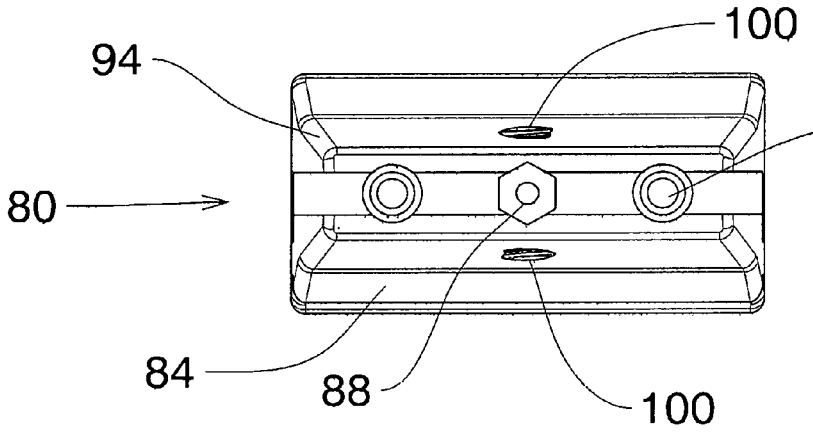
Figure 12:
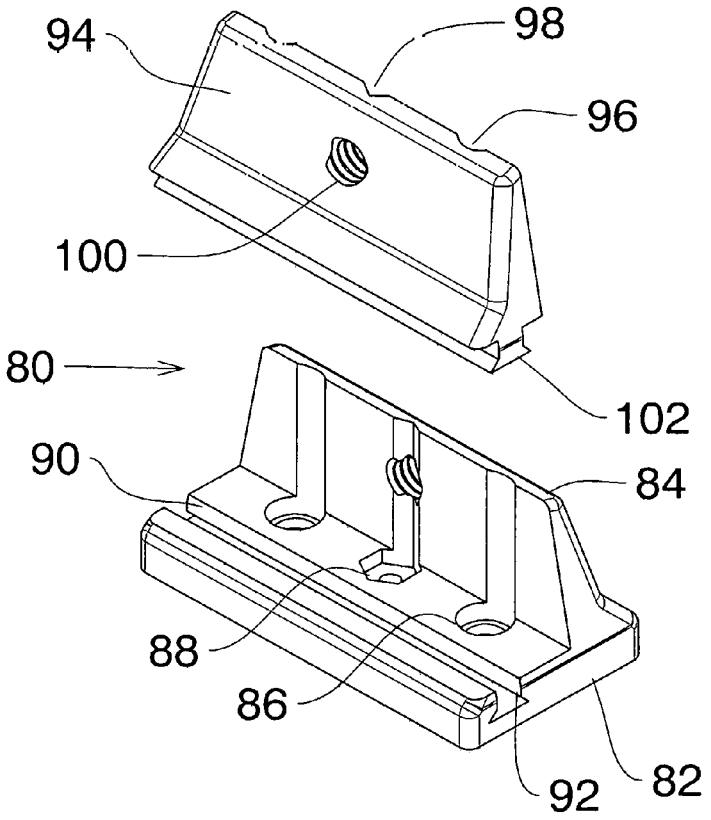

FIG. 11*a* is a perspective of a spacer shim;

FIG. 11*b* is a plan view of the underside of a clamp block;

FIG. 12 is a perspective of a further embodiment; and,

FIG. 13 is a top plan of FIG. 12.

DESCRIPTION OF A SPECIFIC EMBODIMENT

Figure 1:
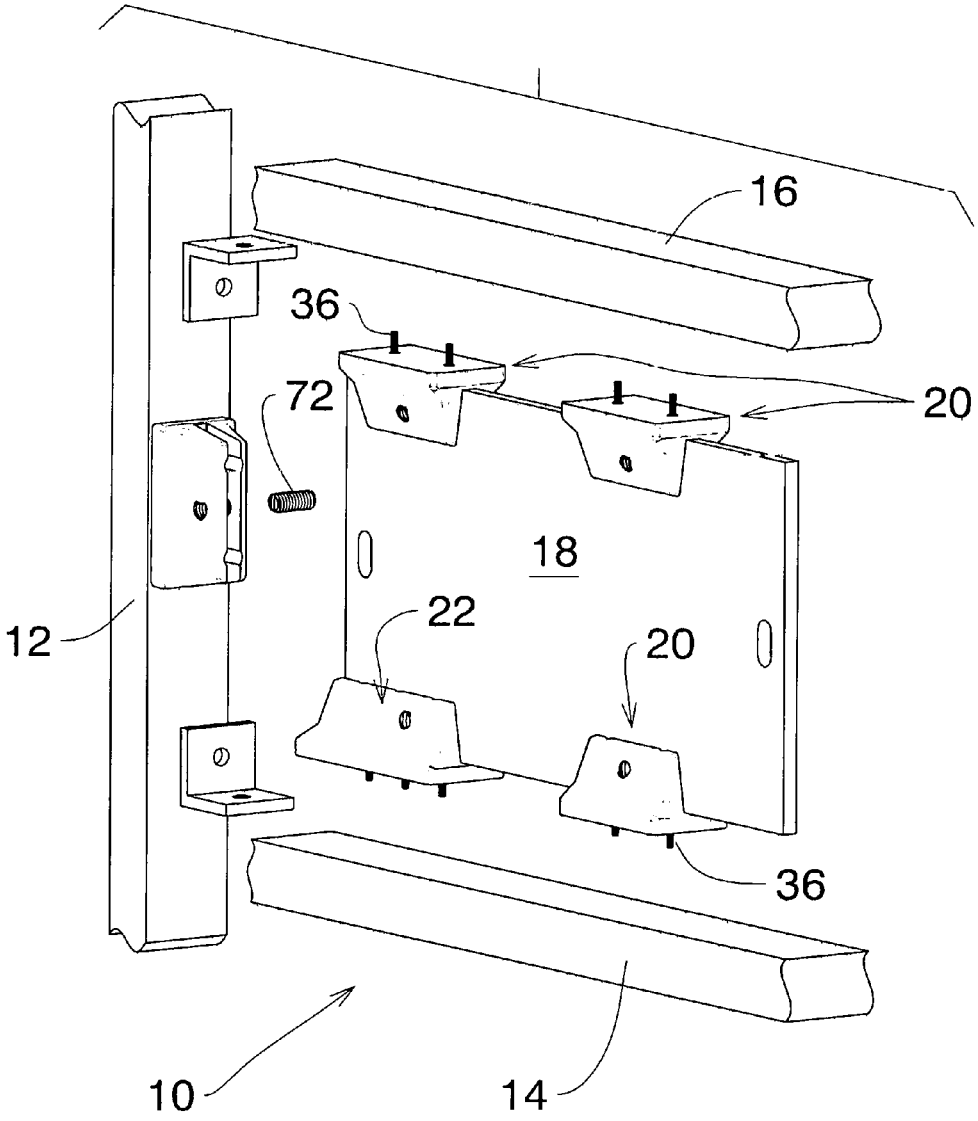
FIG. 1 is an exploded schematic perspective illustration showing part of a typical fence system, illustrating the invention, partially exploded.
Figure 4:
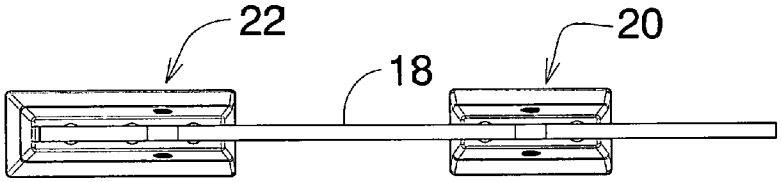
FIG. 4 is a top plan of FIG. 2.
Figure 2:
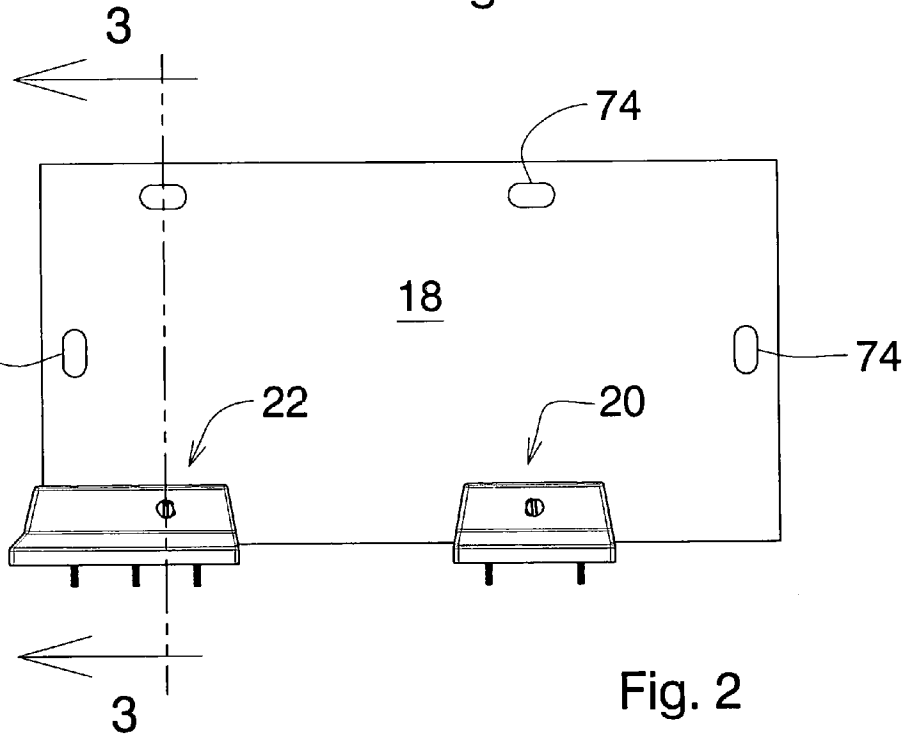
FIG. 2 is a side elevation showing an intermediate clamp block and an end clamp block, and a glass panel.
Figure 3:
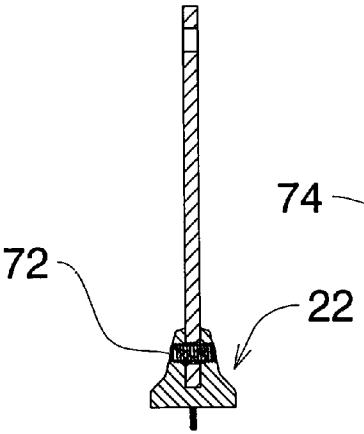
FIG. 3 is a section along 3-3 of FIG. 2.
Figure 5:
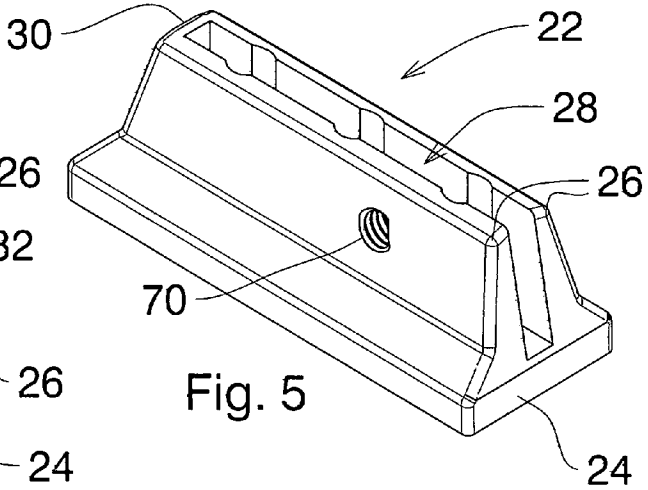
FIG. 5 is a perspective illustration of an end clamp block.
Figure 6:
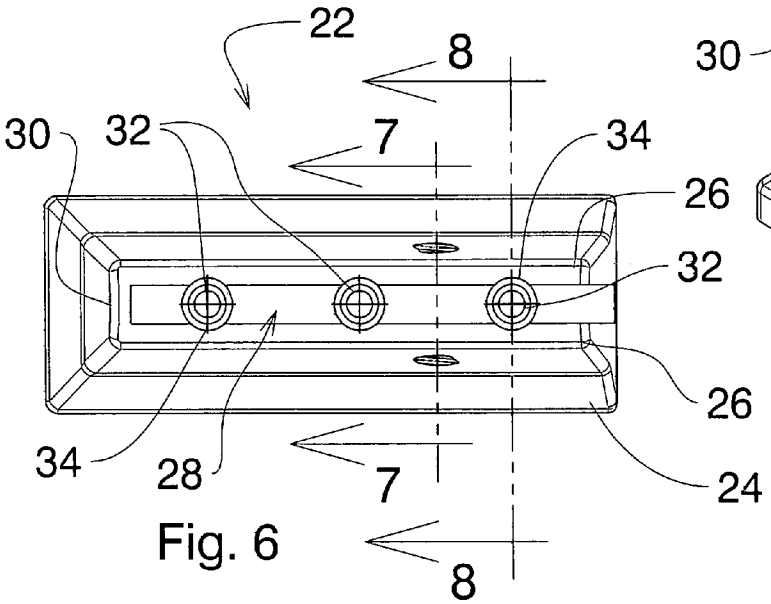
FIG. 6 is a top plan of the clamp block of FIG. 5.
Figure 8:
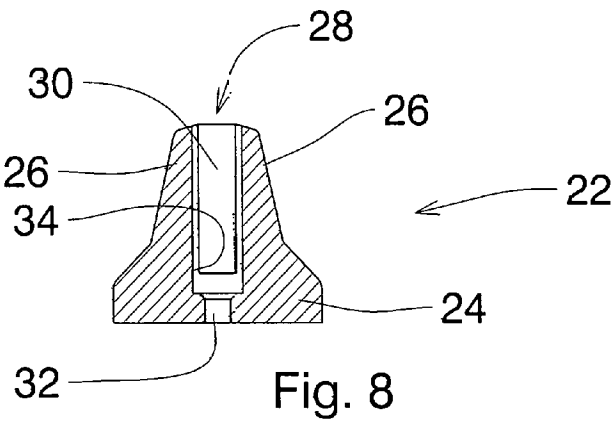
FIG. 8 is a section along 8-8.
Figure 7:
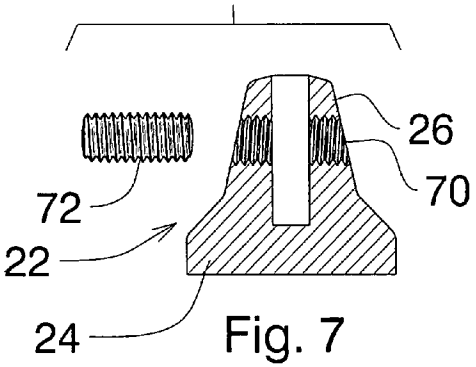
FIG. 7 is a section along 7-7.

Referring first of all to FIG. 1, it will be seen that this illustrates one embodiment of the invention. The illustration shows a typical fence indicated generally as (10). Such a typical fence will consist of a series of upright fence posts (12) mounted on bases (not shown) on a substrate or alternatively simply embedded in concrete bases such as is well known in the art. The fence posts may be of wood, and may also be typically of metal. Fence rails (14) and (16) extend between posts (12). Between the fence posts, panels of glass, rectangular in this case and indicated generally as (18) are supported. The glass panels are supported by means of intermediate clamp blocks (20) and end clamp blocks (22). The clamp blocks may be secured to the posts at spaced apart intervals as shown. The lower horizontal edge of the glass panels may be supported on a fence rail by clamp blocks (20 or 22). Similarly, if required the upper horizontal edge of the glass panels may be supported by an upper fence rail, and attached thereto by means of clamp blocks (20 or 22). Depending on the dimensions of the glass panels, there may be varying numbers of clamp blocks. End clamp blocks (22) are located at the end corners of the glass panels. In this way, the respective adjacent corners of the glass panels are held in the end clamp blocks (22) and intermediate the two end corners, the glass panels are supported by intermediate clamp blocks (20).

The clamp blocks are illustrated in greater detail in FIGS. 2,3,4 and 5. Each end clamp block (22) in this embodiment, may comprise a single homogenous integral molded body, typically formed of synthetic plastic material, although optionally being formed of cast metal if desired.

Each end clamp block (22) will define a base portion (24), and two upstanding flange wall portions (26). Between the two upstanding flange wall portions, an axial channel (28) is provided dimensioned to receive the edge of the glass panel. In the case of the end clamp blocks, one end of the channel is closed off as at (30), the opposite end of the channel being open.

In order to secure the clamp block to a fence post or rail, a plurality of fastening holes (32) are formed perpendicularly through the base (24). Access to the fastening holes will be provided through the channel (28). For this purpose the channel (28) is formed with generally semi-arcuate grooves (34), in the flanges (26) defining the channel, the grooves being axially aligned with the holes. In this way a typical fastening such as a screw or bolt (36) can be passed down through the channel (28) with its head sliding within the two grooves (34) and the threaded portion of the fastening passing through the fastening hole.

In the case of the end clamp block, there are three such fastening holes and a total of six grooves, in this embodiment.

Figure 9:
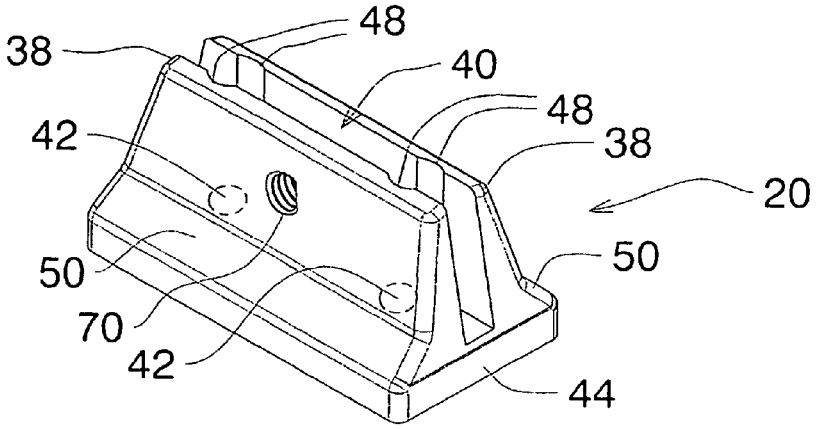
FIG. 9 is a perspective of an intermediate clamp block.

The intermediate clamp blocks (20) are shown in FIG. 9. The intermediate clamp blocks have two upstanding flange wall portions (38) defining an axial channel (40). The channel (40) is open at both ends so that the intermediate clamp block can be secured to the edge of the glass panel intermediate its corners.

Fastening holes (42) are provided perpendicularly through base (44). Access is given to those fastening holes by means of grooves (48) formed in the opposite sides of the flanges (38) defining the channel.

In the case of the illustrated clamp blocks, the base is formed with generally sloping wedge shaped side surfaces (50), and the flanges are formed as upstanding portions, merging with the angled side surfaces (50).

The clamp blocks could be formed with a generally concave or even convex arcuate exterior or any other exterior shaping which is considered desirable.

Figure 10:
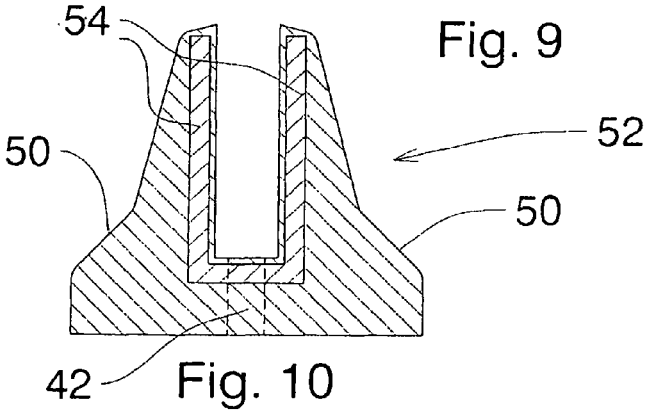
FIG. 10 illustrates an alternate embodiment.

The end and intermediate clamp blocks in this embodiment are formed as one piece homogenous integrally molded structures, which may be molded of synthetic plastic material or which may be of cast metal In some areas it may be required that the clamp blocks be reinforced in some way. In this case, a modified clamp block (52) as shown in FIG. 10 may be provided. In this case, while the clamp block (52) is formed of integrally molded one piece synthetic plastic, a metal reinforcement (54) can be incorporated, as shown. The reinforcement (54) is generally a U-shaped piece of rigid metal which is embedded within the synthetic plastic when it is molded.

In some cases, it may be that there is difficulty in achieving the precise spacing between the fence posts. Spacing between the fence posts should correspond to the width of the glass panels, allowing for sufficient spacing for the attachment of the clamp blocks. In some cases, however it may be necessary to incorporate spacer pads, or "shims", indicated generally as (56) FIG. 11*a*.

These shims (56) would be rectangular blocks of material of any suitable type which can be placed between the base of the clamp block and the fence post.

The shims (56) would be provided with suitable fastening openings (58) for receiving the fastening from the clamp blocks, and allowing the fastenings to be inserted in the fence post.

Shims (56) are additionally provided with locating pins (60), dimensioned and positioned to receive locating recesses (62) on the under side of each clamp block (FIGS. 11*a* and 11*b*).

In order to secure the glass, each clamp block has transverse through openings (70), with interior threads, formed in the flanges. Threaded bolts (72) are passed through the openings (70).

The glass panels are provided with notches (74) to accept the bolts (72). While the foregoing clamp blocks are capable of and suitable for performing the purpose intended, in some cases it may be desirable to make the clamp blocks with one side removable. Such an embodiment is shown in FIGS. 12 and 13. It will be seen that in this case, a modified form of clamp block (80) is shown. This clamp block (80) has a base (82) and an integral upstanding channel flange wall (84). Fastening holes (86) are provided for securing the base to a substrate or a post. In this case, an optional centre fastening hole (88) is shown having a recess of hexagonal outline. This is suitable where it is desirable to secure the clamp blocks by means of bolts (not shown) typically having a hex head.

Along one side of the base (82), there is an axial groove (90). The groove (90) has a shape typically in the form of a key way, with diagonal undercuts (92).

The clamp block (80) further comprises a movable channel flange wall (94), having complimentary grooves (96) and hex recess (98), for permitting access of fastenings as before. Transverse threaded openings (100) are provided to receive a locking bolt as before.

However in this case, the removable wall (94) is provided with an axial key bar (102). The key bar (102) is shaped to conform to the interior shape of the key way groove (90). Assembly proceeds by securing the base (82) to a post or rail and then positioning the glass panel against the fixed wall (84). The key bar (102) of the removable wall (94) is then slid into position in groove (90), and the locking bolt is inserted through recesses (100) in the side walls and the holes in the glass panel, thus holding both the fixed side wall and the removable side wall together.

This arrangement will speed up and facilitate the erection of glass panels in many cases.

While FIGS. 12 and 13 illustrate and describe this modification in use on an intermediate clamp block, it will be appreciated that the same modifications will be applied to the end or corner clamp blocks as well, with minor modifications.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A glass fence support system for a glass fence having a series of spaced apart fence posts and a plurality of glass panels and comprising;

a plurality of clamp blocks, each defining a channel to receive the edge of a glass panel;

a through fastening opening in each said clamp block registering with an opening in the glass panel to secure it;

a plurality of positioning holes in the clamp block for fasteners securing the clamp block to a substrate;

channel walls forming said channel; and semi-circular groove formations formed in said channel walls on opposite sides of each channel permitting fastenings to be inserted therethrough, into said substrate.

2. The glass fence support system as claimed in claim 1 wherein said clamp blocks comprise at least two parts.

3. The glass fence support system as claimed in claim 2 wherein said clamp blocks comprise a first block portion having a base defining a plane, and said positioning holes extending through said base for fastening said base to a substrate, and a fixed channel wall portion defining a plane normal to said base plane, and a movable channel wall portion attachable to said base.

4. The glass fence support system as claimed in claim 3 wherein said base defines a base attachment portion and wherein said movable channel wall portion defines a moveable wall attachment portion and wherein said base attachment portion and said moveable wall attachment portion are interengageable with one another to form a said clamp block.

5. The glass fence support system as claimed in claim 4 wherein said base attachment portion comprises a base recess formed in said base, and wherein said moveable wall attachment portion defines a moveable wall protrusion interengageable with said base recess.

6. The glass fence support system as claimed in claim 5 wherein said base recess is an axial groove formed in said base, and defining a base key way with undercut wall regions, and wherein said moveable wall protrusion defines an axial key bar, said key bar having a cross sectional shape complimentary to and interfitting with said base key way.

7. The glass fence support system as claimed in claim 1, including a plurality of vertical fence posts, with clamp blocks secured in spaced apart locations on said posts for securing upright edges of said glass panels.

8. The glass fence support system as claimed in claim 1 including upper and lower fence rails with upper and lower clamp blocks secured to the upper and lower rails, securing upper and lower edges of the glass panels between them.

9. The glass fence support system as claimed in claim 1 including spacer pads to accommodate variations in spacings of upright post members in a fence system.

10. The glass fence support system as claimed in claim 9 including an intermediate clamp block in which the channel is open at both ends, for securing an intermediate position on the glass panel, and further including an end clamp block having a blind end formed at one end of the channel for securing the opposite ends of the glass panel at its corners.

11. The glass fence support system as claimed in claim 10 wherein the clamp blocks are formed of a synthetic material and including a metal reinforcement within said synthetic material.

12. A glass fence comprising;

a plurality of upright fence posts mounted parallel to one another at spaced apart intervals;

a plurality of fence rails connected transversely between adjacent fence posts;

a plurality of glass panels supported between adjacent said posts and said fence rails;

clamp blocks secured to some of said fence posts and said fence rails, and engaging edge portions of respective glass panels;

a channel in each said clamp block to receive the edge of a glass panel;

through fastenings in each said clamp block registering with an opening in the glass panel to secure it in the channel;

a plurality of positioning holes for fasteners securing the clamp block to a substrate;

channel walls forming said channels; and, semi-circular groove formations formed in said channel walls on opposite sides of each channel permitting fastenings to be inserted there through, into said substrate.

13. The glass fence support system as claimed in claim 12 wherein said clamp blocks comprise a base block portion having a base defining a plane, and fastening holes in said base for fastening said base to a substrate, and a fixed wall portion defining a plane normal to said base plane, and further comprises a movable wall portion attachable to said base block portion.

14. The glass fence support system as claimed in claim 13 wherein said base block portion defines a base attachment portion and wherein said movable wall defines a moveable wall attachment portion and wherein said respective attachment portions are interengageable with one another to form a said clamp block.

15. The glass fence support system as claimed in claim 14 wherein said base attachment portion comprises a base recess formed in said base, and wherein said moveable wall attachment portion defines a protrusion interengageable with said base recess.

16. The glass fence as claimed in claim 15 wherein said base recess is an axial groove formed in said base, and defining a key way with undercut wall regions, and wherein said moveable wall protrusion defines an axial key bar having a cross sectional shape complimentary to and interfitting with said key way.

17. The glass fence as claimed in claim 12 including an intermediate channel block in which the channel is open at both ends, for securing an intermediate position on the glass panel, and further including an end clamp block having a blind end formed at one end of the channel for securing the opposite ends of the glass panel at its corners.

* * * * *